United States Patent [19]

Wagner

[11] 4,085,902

[45] Apr. 25, 1978

[54] STRAIGHT HOLE FORMATION WITH MOVING GUIDE PATH

[75] Inventor: William A. Wagner, Somers, N.Y.

[73] Assignee: Windings, Inc., Goldens Bridge, N.Y.

[21] Appl. No.: 787,304

[22] Filed: Apr. 14, 1977

Related U.S. Application Data

[63] Continuation of Ser. No. 690,882, May 28, 1976, abandoned.

[51] Int. Cl.[2] ..... B65H 54/28; B65H 55/02

[52] U.S. Cl. ..... 242/43 R; 242/18 R; 242/158 R; 242/163

[58] Field of Search ..... 242/43 R, 18 R, 43 A, 242/43 AB, 43 M, 25 R, 158 R, 158 B, 158 F, 158.1, 158.2, 158.3, 158.4 R, 158.4 A, 158.5, 157.1, 163

[56] References Cited

U.S. PATENT DOCUMENTS

| | | | |
|---|---|---|---|
| 2,634,922 | 4/1953 | Taylor, Jr. | 242/163 |
| 2,660,382 | 11/1953 | Wilson | 242/158 R |
| 3,666,200 | 5/1972 | Newman et al. | 242/163 |
| 3,695,523 | 10/1972 | Genson et al. | 242/18 R |
| 3,747,861 | 7/1973 | Wagner et al. | 242/18 R |
| 3,819,122 | 6/1974 | Genson | 242/43 R X |
| 3,845,912 | 11/1974 | Eichmanns et al. | 242/43 R X |

FOREIGN PATENT DOCUMENTS

| | | | |
|---|---|---|---|
| 1,186,335 | 4/1970 | United Kingdom | 242/25 R |

*Primary Examiner*—Stanley N. Gilreath
*Attorney, Agent, or Firm*—Watson, Cole, Grindle & Watson

[57] ABSTRACT

In winding coils of great wall thickness, such coils including a plurality of layers each formed of a plurality of figure-8s with the cross-overs progressing angularly around in each layer and with a radial hole extending from the outside of the coil into the axial opening thereof, by previous winding methods it is likely that the hole will be curved, even in cases where the guide for traversing the flexible material on the mandrel is spaced away from the mandrel and the outside of the wound material. In order to prevent the formation of a curved hole and to ensure that the hole is substantially radial, the guide carrier is moved in such a way that the line from the carrier to the surface of the coil always remains substantially tangential to the package at the same angular position in space with respect to the mandrel.

2 Claims, 4 Drawing Figures

STRAIGHT HOLE FORMATION WITH MOVING GUIDE PATH

This is a continuation of application Ser. No. 690,882 filed May 28, 1976, now abandoned.

BACKGROUND OF THE INVENTION

Field of the Invention

The invention relates to a method of producing a coil of flexible material wound in layers of figure-8s with the cross-overs in each layer progressing around the package but leaving a radial opening into the coil from the outside to the axial opening thereof.

Such coils may be produced for example as shown in Taylor U.S. Pat. No. 2,634,922 or Newman U.S. Pat. No. 3,666,200. It has been found however, when forming such coils, even in the case of a so-called off-the-face wind, that is a wind in which the path of the guide is at a substantial distance from the surface of the coil being wound, that the hole is apt to be curved.

An arrangement for preventing this curvature on an on-the-face wind, that is a wind in which the guide swings away from the package during the formation but is kept rather close to the surface, is shown in Wagner U.S. Pat. No. 3,747,861.

SUMMARY OF THE INVENTION

According to the present invention, in an off-the-face wind, a straight hole is produced by moving the track of the guide as the coil is formed, to such a degree that the line from the guide to the surface of the coil being formed always remains tangent to the surface of the coil at the same angular position in space with respect to the mandrel.

DESCRIPTION OF THE PREFERRED EMBODIMENTS

Figure 1:
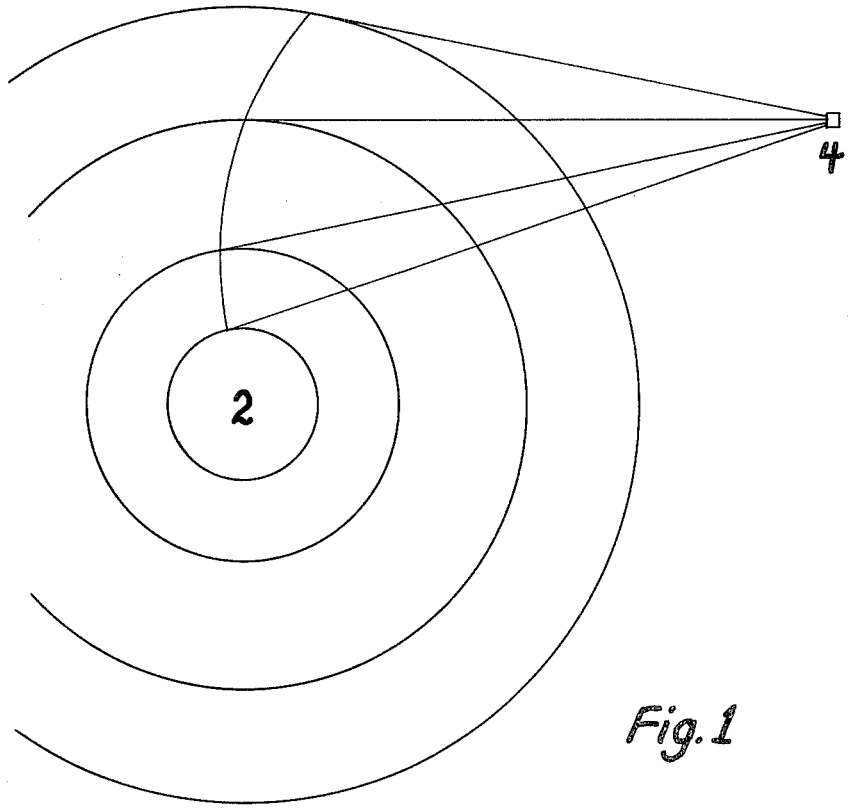
FIG. 1 shows the manner in which, in an off-the-face wind, a curved hole is likely to be formed.

Referring to FIG. 1, there is shown a mandrel 2 on which a wind is to be laid by feeding the material through a reciprocating guide 4, the movements being coordinated so that, as shown in the prior patents referred to above, the cross-overs in each layer move progressively around the coil. Preferably, as is shown in the Newman U.S. Pat. No. 3,666,200, the cross-overs in successive layers progress in opposite directions around the coil, and their extent is somewhat less than 360° so as to leave a radial hole through the wall, through which the inner free end of the material can be drawn for twistless payout.

While the mechanisms shown in the prior art are satisfactory for coils of relatively small wall thickness, it has been found that, when winding coils having a wall thickness more than twice the radius of the mandrel, the hole becomes curved, the position of the hole always occurring at the point of tangency of the line from the guide 4 to the periphery of the wind. This slight curvature in thin-walled coils is not damaging, but it is obvious that in thicker-walled coils it would be impossible to insert a straight tube through the opening.

Figure 2:
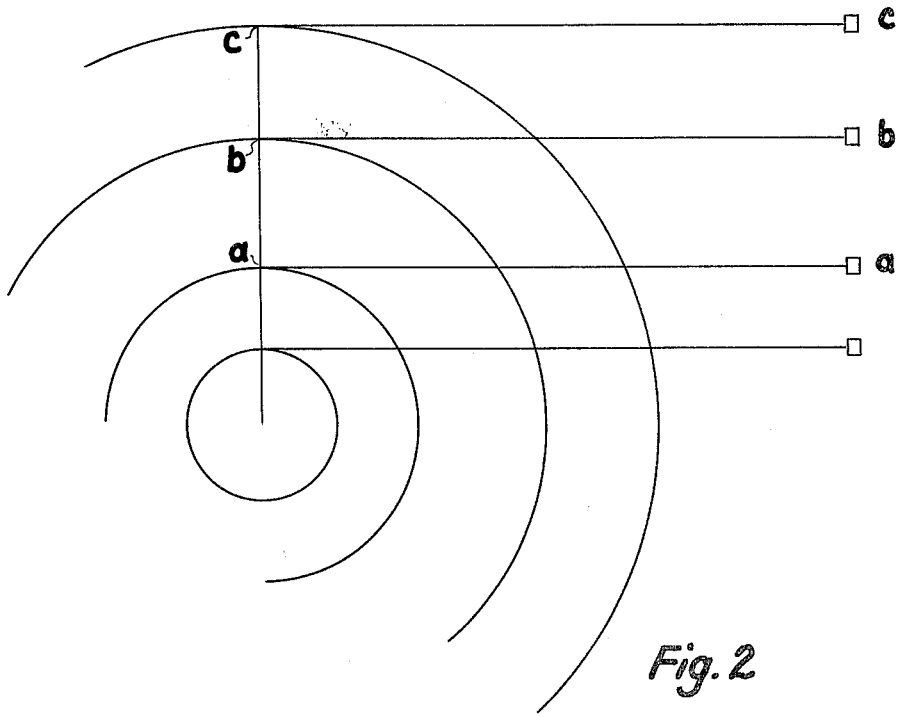
FIG. 2 shows diagrammatically the manner of operation of the present invention.

In accordance with the present invention, this fault is overcome by moving the guide continuously or substantially continuously during the winding, so that the line joining the guide to the periphery of the coil always remains substantially tangential at the same angular position in space to the outside of the wind. This is shown in FIG. 2, where the positions *a, b* and *c* indicate the movement of the guide to ensure this condition.

Figure 3:
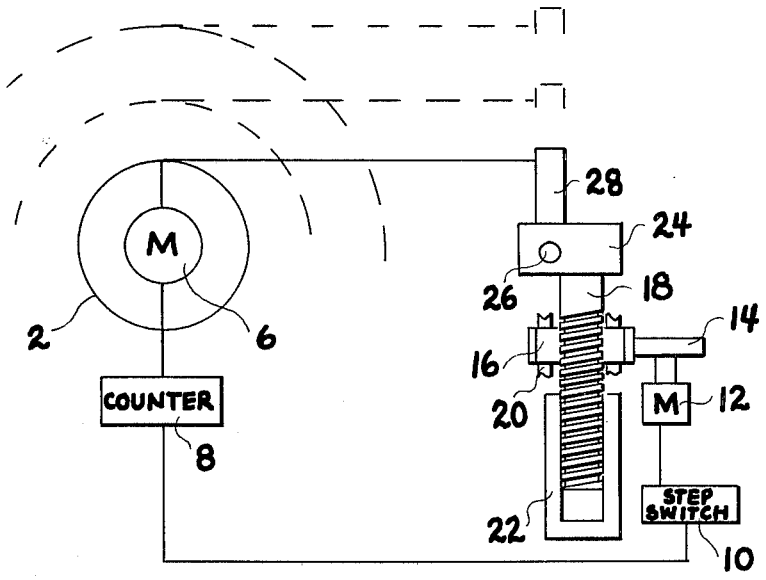
FIG. 3 shows a mechanism for carrying out the invention.
Figure 4:
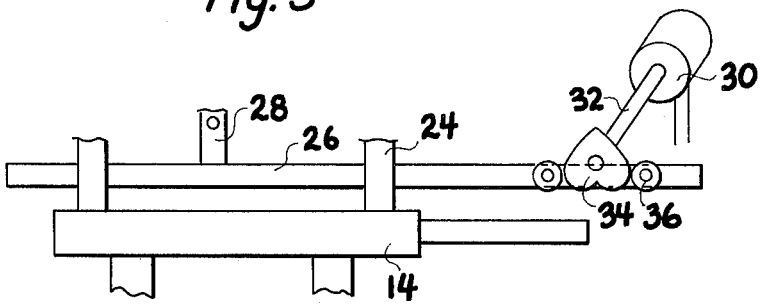
FIG. 4 is a front view of FIG. 3.

Referring to FIGS. 3 and 4, there is shown a mechanism for carrying out this concept. The mandrel 2 is driven by a motor 6, which is connected to a counter 8 which in turn through a step switch 10 imparts periodical impulses to a motor 12. The motor 12 through gearing 14 drives a nut 16 threaded on a stem 18, the nut 16 being held between bearings or stops 20 to prevent vertical movement thereof. This member 18 is guided in a sleeve 22 fixed on the machine frame.

There will preferably be two such stems, supporting a frame member 24 in which is slidable a bar 26 carrying a guide member 28.

The mechanism for reciprocating the bar 26 is merely indicated schemmatically, since its details form no part of the invention. It includes a motor 30 with a motor shaft 32 carrying a heart-shaped cam 34 which is engaged between rollers 36 turnably mounted on the bar 26. Of course the motor 30 is synchronized with the motor 6, the two being slightly out of phase to cause the cross-overs to progress around the coil and preferably producing a so-called plus-minus wind in which the cross-overs progress in opposite angular direction from one layer to the next.

As a result of this arrangement, the counter is set so that the motor 12 is operated sufficiently often to produce the results shown, namely that the line from the guide to the winding being built up remains substantially constant at all times to the same angular position (in space) of the winding, so that the hole formed will remain substantially radial.

I claim:

1. In a machine for winding flexible material into a package comprising a rotatably driven spindle, a movable material guide, means to reciprocate the guide along the spindle so as to lay upon the spindle successive layers of figure-8 windings in which the crossovers progress angularly around the package in each layer, and means to change the relative movement between the spindle and guide so as to produce in each layer of the windings a hole therethrough, the improvement comprising, means to shift the reciprocating travel path of the guide progressively with respect to the spindle in synchronism with the rotation of the spindle so as to maintain a line joining the reciprocating travel path of the guide to the surface of the material wound on the spindle at all times tangent to such surface in the same spatially fixed line radial to the axis of rotation of the spindle, whereby the holes in the layers of the windings are radially aligned to form a straight hole radially of the package.

2. In a winding machine as claimed in claim 1, wherein said means to shift the reciprocating path of the guide includes a frame, the guide being carried by the frame, and means to move the frame and guide in a direction transverse to the line joining the travel path of the guide to the surface of the package.

* * * * *